US005706846A

United States Patent [19]

Sutton

[11] Patent Number: 5,706,846

[45] Date of Patent: Jan. 13, 1998

[54] PROTECTIVE ACTION SYSTEM INCLUDING A DEPLOYABLE SYSTEM

[75] Inventor: Debra Lynne Sutton, Napa, Calif.

[73] Assignee: United Defense, L.P., Arlington, Va.

[21] Appl. No.: 721,404

[22] Filed: Sep. 26, 1996

Related U.S. Application Data

[60] Provisional application No. 60/004,644 Sep. 27, 1995.

[51] Int. Cl.[6] ..... E04H 9/00

[52] U.S. Cl. ..... 135/128; 135/93; 135/97; 135/95; 135/900; 52/2.11; 52/2.17

[58] Field of Search ..... 135/95, 93, 91, 135/900, 97; 52/2.11, 2.16, 2.17, 2.19

[56] References Cited

U.S. PATENT DOCUMENTS

| | | | |
|---|---|---|---|
| 3,272,199 | 9/1966 | Matthews | 135/93 X |
| 4,706,551 | 11/1987 | Schofield | 135/93 X |
| 4,883,512 | 11/1989 | Griffis | 135/97 X |
| 5,018,321 | 5/1991 | Wardlaw, III | 52/2.17 |
| 5,314,377 | 5/1994 | Pelosi, III | 135/128 X |
| 5,331,991 | 7/1994 | Nilsson | 135/93 |
| 5,361,550 | 11/1994 | Kaden | 135/93 X |
| 5,406,753 | 4/1995 | Grenci et al. | 52/2.11 |
| 5,537,784 | 7/1996 | Baldwin | 52/2.17 |

*Primary Examiner*—Wynn E. Wood
*Attorney, Agent, or Firm*—Douglas W. Rudy; Michael Lee

[57] ABSTRACT

A deployable flexible walled enclosure for housing people in the event of a serious air quality degradation is provided. A pressurized enclosure, either stored in a permanent location or transportable to a selected site, includes an air supply system for filtering and subsequently supplying clean air to the interior of the enclosure. The structure is compactly packaged when not in use and is capable of being deployable and/or activated from a remote control station in time of need. A small cache of life support elements are stored in the predeployed enclosure for use as needed upon deployment.

3 Claims, 12 Drawing Sheets

FIG_4
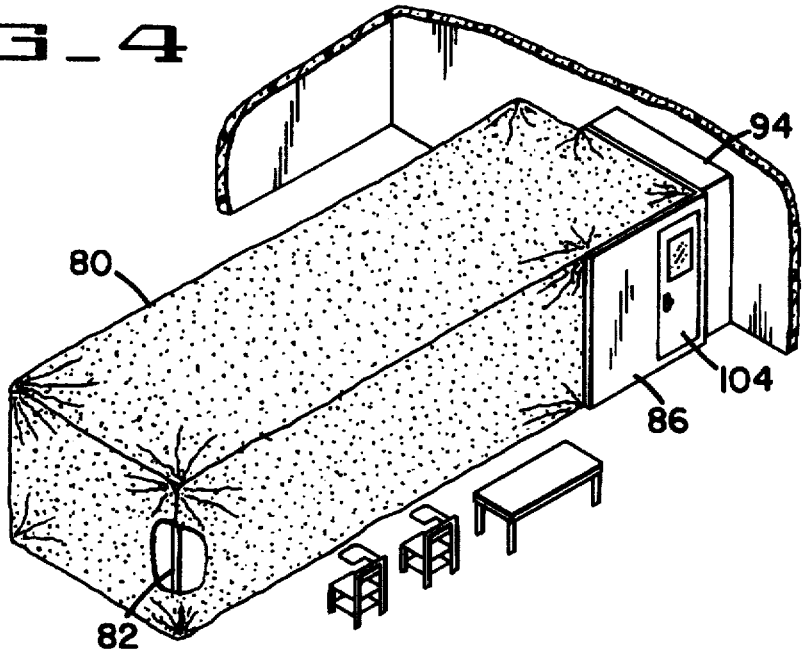
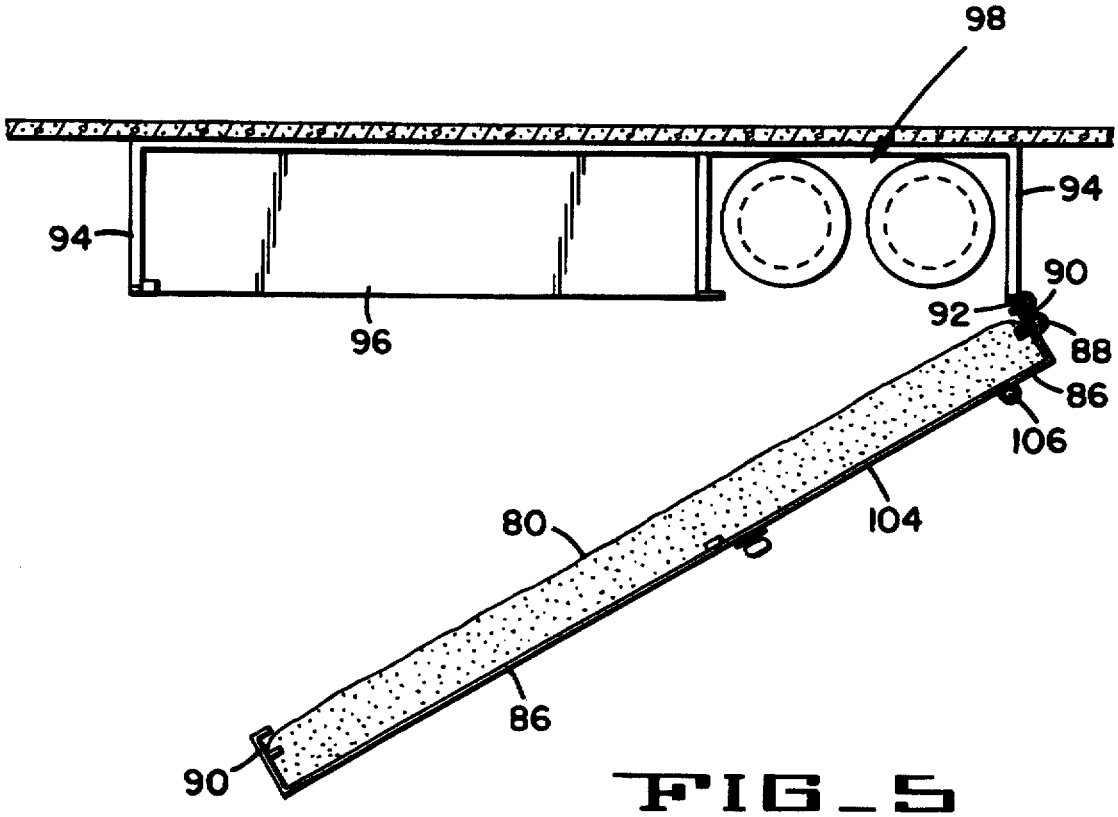
FIG_5

NOTE:
PAS PROTECTION SITE CAN BE ANY ONE OF A BPS SITE, CPS SITE, AND A DCS SITE.

PROTECTIVE ACTION SYSTEM INCLUDING A DEPLOYABLE SYSTEM

This application is based on a U.S. provisional application filed Sep. 27, 1995 having Ser. No. 60/004,644 and priority in that application is claimed for this application.

This invention relates to a system for protection of individuals in a community from exposure to toxic agents, and more particularly to such a system which includes automation and integrated control, warning and communication systems.

The residents of any industrial community are at risk from exposure to various materials or agents which are potentially harmful to their health and perhaps even life threatening. The agents to which they may be exposed will vary depending upon the activity being conducted in the vicinity, and may include, for example, potential exposure to radio-active particulate fall-out resulting from an accident at a nuclear power plant, toxic chemical agents accidentally discharged from an industrial plant, or biological and/or toxic chemical agents unintentionally dispersed into the atmosphere during the disposal of weapons containing the same. The majority of the individuals requiring protection in the community, when instructed to do so, will be capable of quickly moving on their own initiative to the nearest one of a number of strategically placed community shelters. A smaller, but significant number will not be physically able or cannot reliably be expected to do so. This portion of the population is comprised of those residents most vulnerable to the effects of the toxic agents and include the elderly, the ill, and the very young, as well as the handicapped since their mobility is often restricted. A portion of the population at risk in a community may require rest and relief or decontamination prior to sheltering or evacuation outside of the affected area, or before efforts at protecting the community from the toxic environment can continue. The latter group could include civilian population involved in the incident who require rest and relief or decontamination, and/or civilian civil defense or military personnel who have responded to the emergency and are required to work in a potentially toxic environment in order to secure the safety of the general population. A complete, integrated protective action system should not only accommodate all of the aforementioned segments of the community population but also provide basic life support as well as physical and psychological comfort until the threat has passed.

The present invention comprises an integrated protective action system which protects both the ambulatory and non-ambulatory portions of the population of a community from exposure to toxic agents including nuclear fall-out, biological and/or chemical agents, which incorporates self-sustaining structures for protection of large groups, in-structure shelters for installation in existing structures capable of easy set up and operability while minimizing the impact thereon or impairing the use thereof and integrated mobile units for decontamination and rest and relief, which delivers basic life support during the time the threat of exposure exists, which supplies one or two-way communication channels with a central command station, which provides basic life support and sustaining facilities and equipment, which incorporates many common components to reduce maintenance and training requirements, which incorporates security from vandalism, which is capable of automatically alerting an individual site or sites and/or the community through a local area warning system of the danger, such by energizing a siren, for example, and activating the air filtration system, which accommodates and adjusts to electrical power outages and includes provisions for degraded modes of operation, which permits easy ingress and egress and either automatic deployment and activation of the individual systems from a central command station or manual initiation of the systems at the local site, and which offers physical and psychological comfort.

These and other attributes of the present invention, and many of the attendant advantages thereof, will become more readily apparent from a perusal of the following description and the accompanying drawings, wherein:

FIG. 4 is a pictorial view of a building protection system in its deployed configuration incorporated into an existing structure;

FIG. 5 is a horizontal sectional view showing the building protection system of FIG. 4 in its compact configuration with its panel and frame open for service and maintenance, as in initial deployment or in preparation for stowage;

Figure 15:
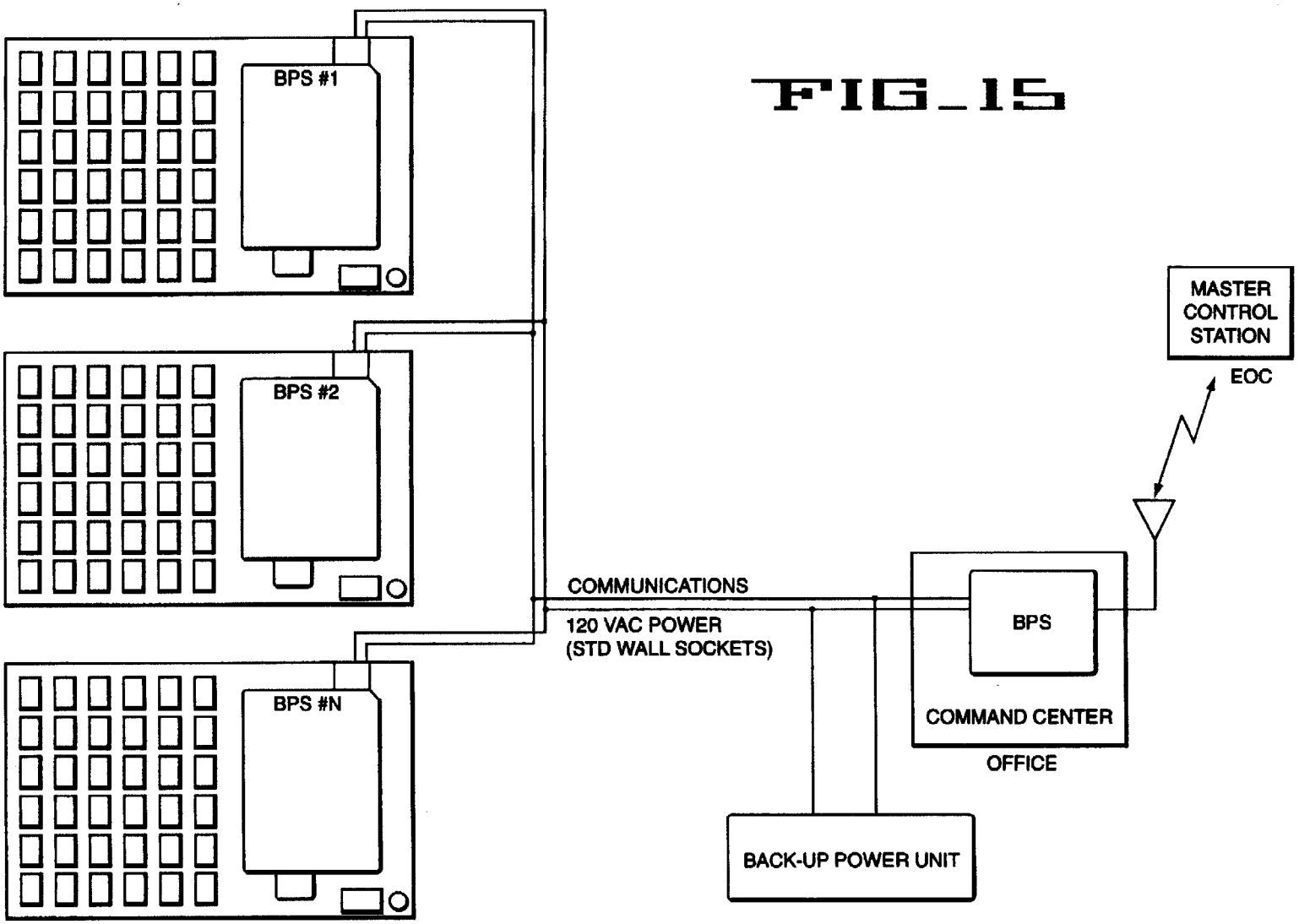
Figure 16:
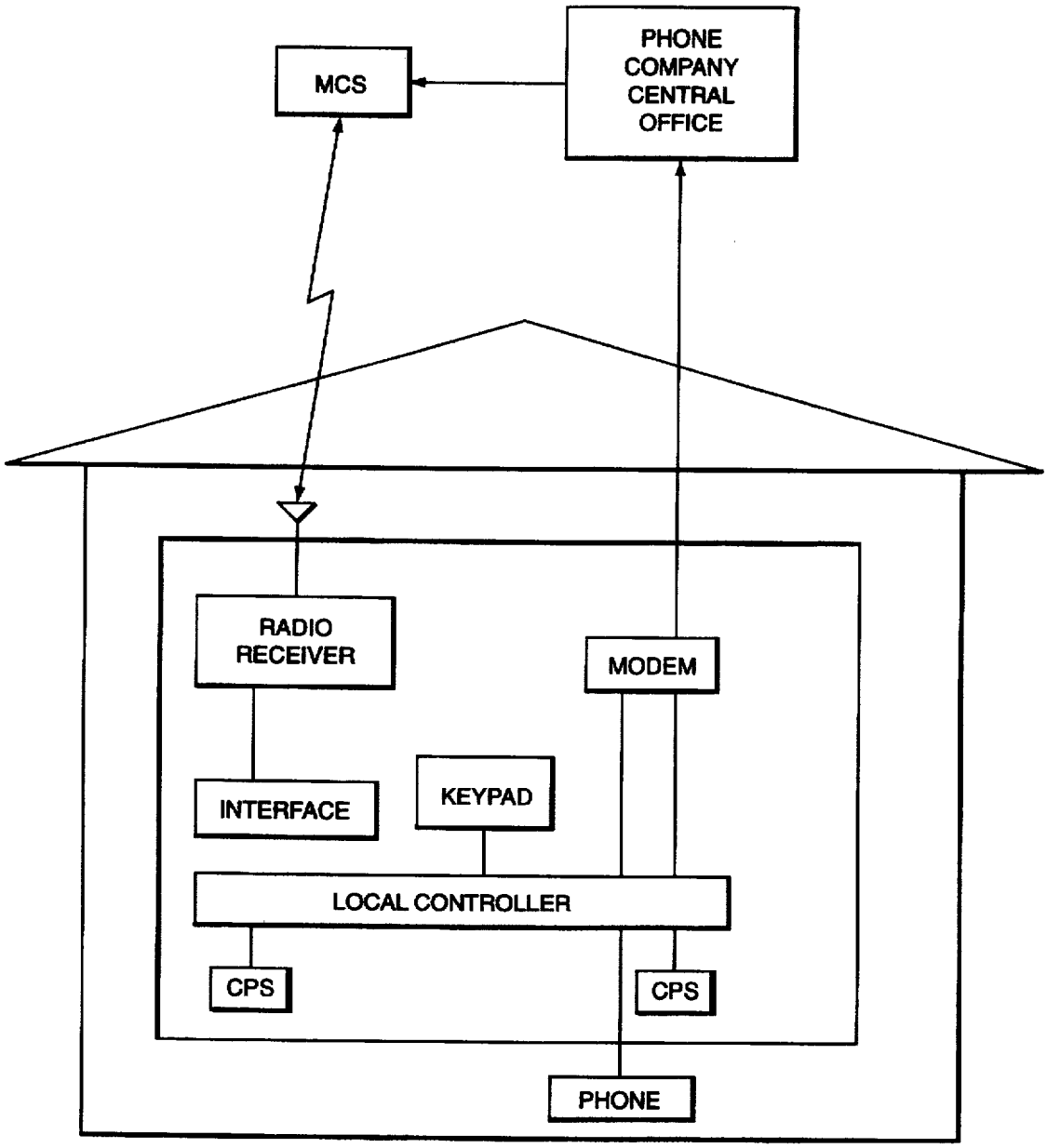

FIG. 15 is a schematic representation of the communication system between the master control station, the command center within an existing structure, and each of the building protection systems also installed therein; and FIG. 16 is a schematic representation of another means for data collection and communication using an RF signal for incoming messages and local phone lines for outgoing messages.

Figure 1:
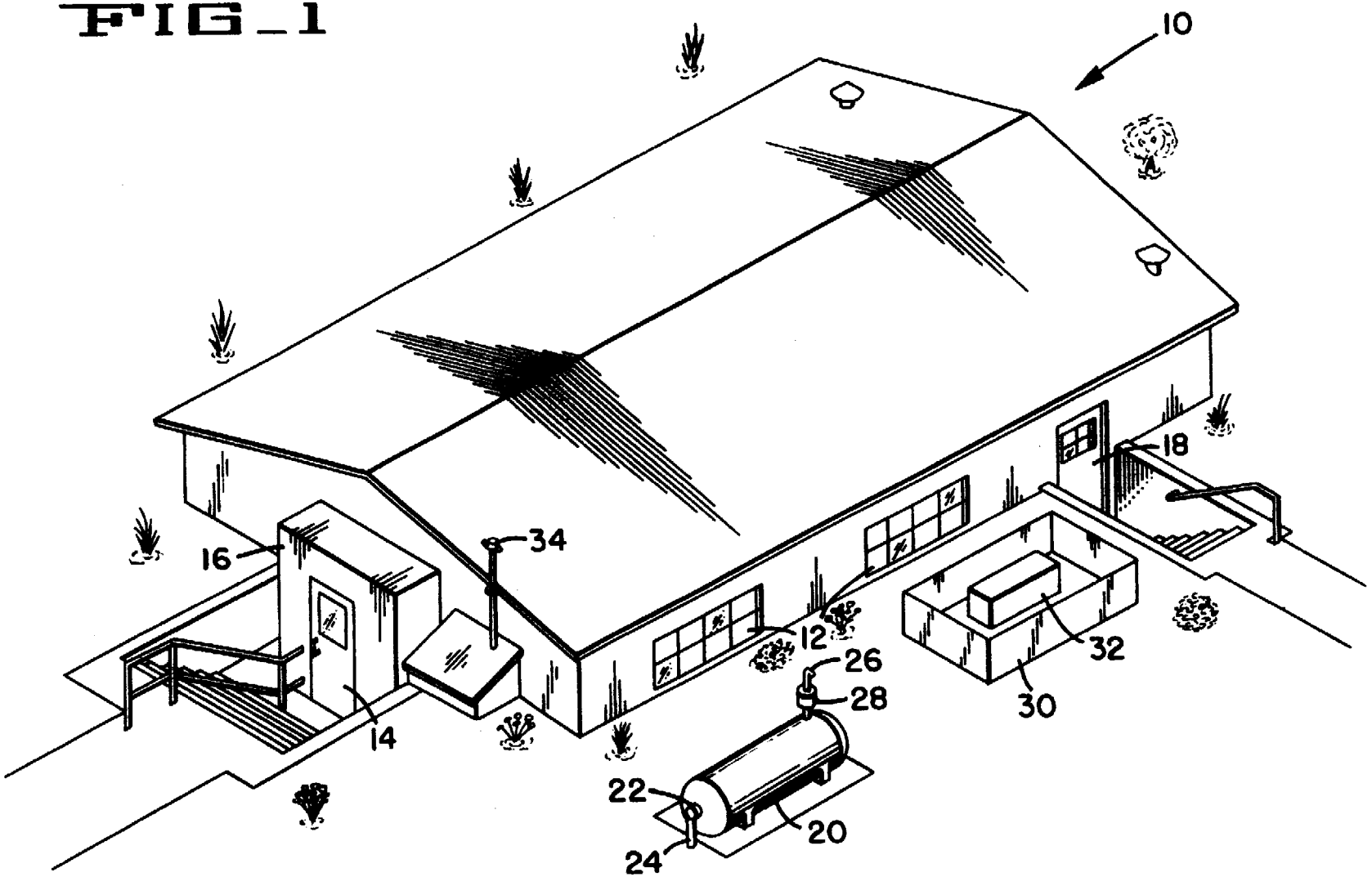
FIG. 1 is a pictorial view of a partially below-grade building incorporating a community protection system according to the present invention.
Figure 2:
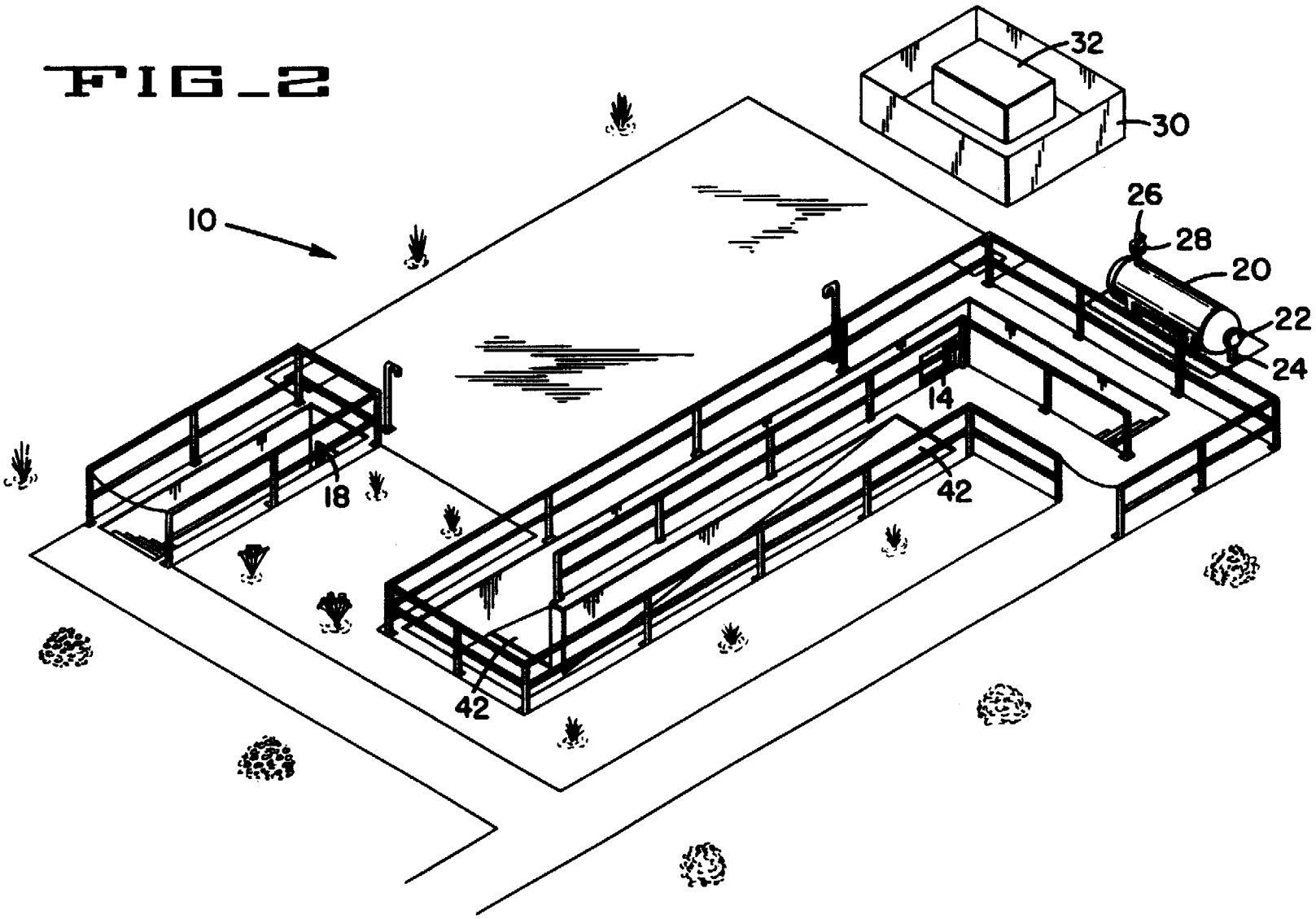
FIG. 2 is a pictorial view of an underground structure incorporating a community system according to the present invention.

Referring to FIG. 1, there is shown a community protection system (CPS), which is one of the three basic types of protective action systems (PAS), comprising a building, generally shown at 10, which may be constructed of any suitable construction capable of maintaining overpressurization, such as pre-engineered steel, precast concrete or concrete block construction, for example, is sized to accommodate a relatively large group of people. The actual number of people to be accommodated within the building 10 will be dependent upon the enclosed space, the capacity of the air filtration system and the life-sustaining supplies available to the occupants. These variables can be scaled to accommodate a variety of localized population densities through the use of modular design, as will be explained hereinafter. The building 10 may be configured to be above grade, partially above grade, as shown in FIG. 1, or below grade, as shown in FIG. 2. The PAS can accommodate short term or long term housing and protection for its occupants. Since all PAS are designed to house the occupants for an extended period of time, there is a psychological benefit in permitting the occupants visual recognition of day and night. Thus, if configuration permits, the building 10 may be provided with windows, 12, having panes of high strength translucent material or glass block which admit light into the interior of the building. The community PAS is adaptable to, and can be located in, rural and urban, including both residential and commercial, areas. A outer main entry door 14 provides entry, through an air lock 16, into the building 10 for individuals, who would be educated about and trained in the use of the CPS, and in case of an emergency would use the CPS for protection. Additional doors 18 may also be provided to facilitate ingress and egress of the occupants, and may be provided with an air lock similar to air lock 16. Since it is intended that the building 10 will serve purposes other than as a CPS, such as a tornado shelter if the building has been designed to withstand the effects thereof and if not, as a disaster relief building with self-supporting power and life sustaining supplies, for example, the additional doors also permit more rapid ingress of those individuals seeking refuge and rapid egress in case of an emergency, such as a fire, within the CPS itself.

In the event of a toxic threat, the normal water supply system, e.g. the local municipal water system, may be contaminated by the toxic agents. A tank 20 functions as a self-contained supply of potable water and is connected through an underground pipe to the plumbing system within the building 10. If the tank 20 is itself connected to the normal water supply system, an electronically actuated valve 22 is interposed between the tank 20 and the supply line 24, which valve when closed, will isolate the water in the tank from the municipal water supply system. A vent pipe 26 connects the interior of the tank 20 with the atmosphere in order that the water therein will flow freely into the building's plumbing system. The water in the tank should be replaced, either by manually draining and refilling it or by circulating water through the tank, to assure an acceptable level of freshness. To prevent the toxic agents in the atmosphere from being drawn into the tank 20 and contaminating the water therein, a replaceable particulate and gas filter 28 is interposed in the vent pipe 26. Alternately, the vent pipe 26 can be eliminated and instead a sealed collapsible bladder inside the tank can be utilized, or the tank can be pressurized with a non-toxic gas. Another alternative is to extend the vent pipe 26 so that it is in communication with the interior of the building; the air thus being drawn into the tank having been decontaminated by the filter system for the building itself.

A fenced enclosure 30, to reduce the possibility of vandalism, surrounds a unit 32 which includes an air management system and a power management system to respectively supply conditioned air and electrical power to the building 10. Electricity is necessary for lighting, cooking and the like within the building and to power the communications and control system and the air filtration system, as well as the air management portion of the unit 32. The air management system may be any type of conventional air conditioning unit, but preferably is a heat pump so that both cooled, dehumidified air and heated air can be provided as the ambient conditions dictate. The power management portion of the unit 32 is a conventional motor/generator unit having a prime mover, such as an internal combustion engine, driving an electrical generator, and includes provisions for automatic operation in the event of a grid power failure. An antenna 34 is mounted adjacent the building's exterior and functions to link the communications and control system with a remote master control station in a manner to be more fully explained hereinafter.

The CPS shown in FIG. 2 is similar to the CPS of FIG. 1, except the building 10 is below grade. While the CPS of FIG. 2 also provides protection for ambulatory individuals, it includes ramps 42 to permit wheelchair access and facilities for accommodating physically challenged persons. The below grade structure of FIG. 2 is inherently strong and less affected by high winds, and is, therefore, particularly desirable in communities that have a higher potential for hurricanes and tornadoes because of the potential for also using the CPS as a hurricane or tornado shelter. Each CPS is provided with means for back-up electrical power, for air filtration using media for removal of airborne particulates (solid and liquid) and toxic gases from the air being introduced into the CPS, for environmental control to heat and cool the air as needed, for integrated systems control for automation and diagnostic analysis of the other systems, for communications linkage to a master control station, for sealability or air leakage reduction management, for ease of entry and exit under hazardous or emergency conditions while maintaining the integrity of the clean environment within the CPS, for life sustainment, life support and habitability for extended periods of time (up to several days), and for redundancy of the systems which are critical to survival. In addition, the CPS and all of its related systems are corrosion resistant and capable of being reconditioned after having been contaminated to restore the CPS to full functionality, and are preferably also designed for dual purpose usage by the community in which it is situated. Dual purpose is intended to include, in addition to use as a CPS, use of the CPS facility as a disaster relief facility, hurricane or tornado shelter, evacuation shelter and emergency responders facility. Life sustainment includes facilities for decontamination and rest and relief, including chairs and beds, etc., and provision of non-contaminated food and water, medical and hygiene supplies and equipment and spare clothing. Life support includes lighting, rest room facilities, sinks, showers, tubs, microwave ovens, refrigerators and other such equipment for the preparation and storage of food.

Figure 3:
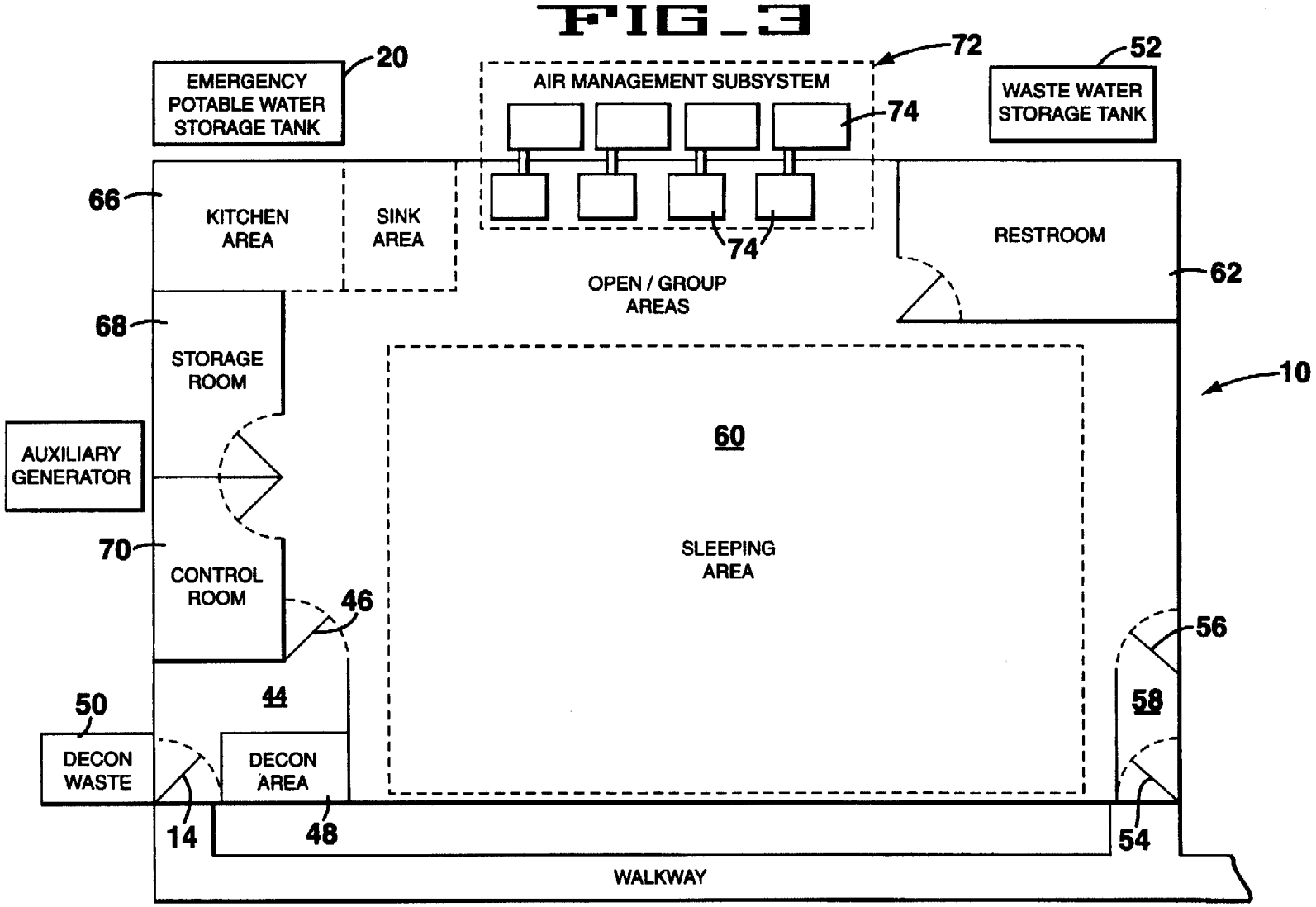
FIG. 3 is a top plan view of a structure similar to that shown in FIGS. 1 and 2.
Figure 6:
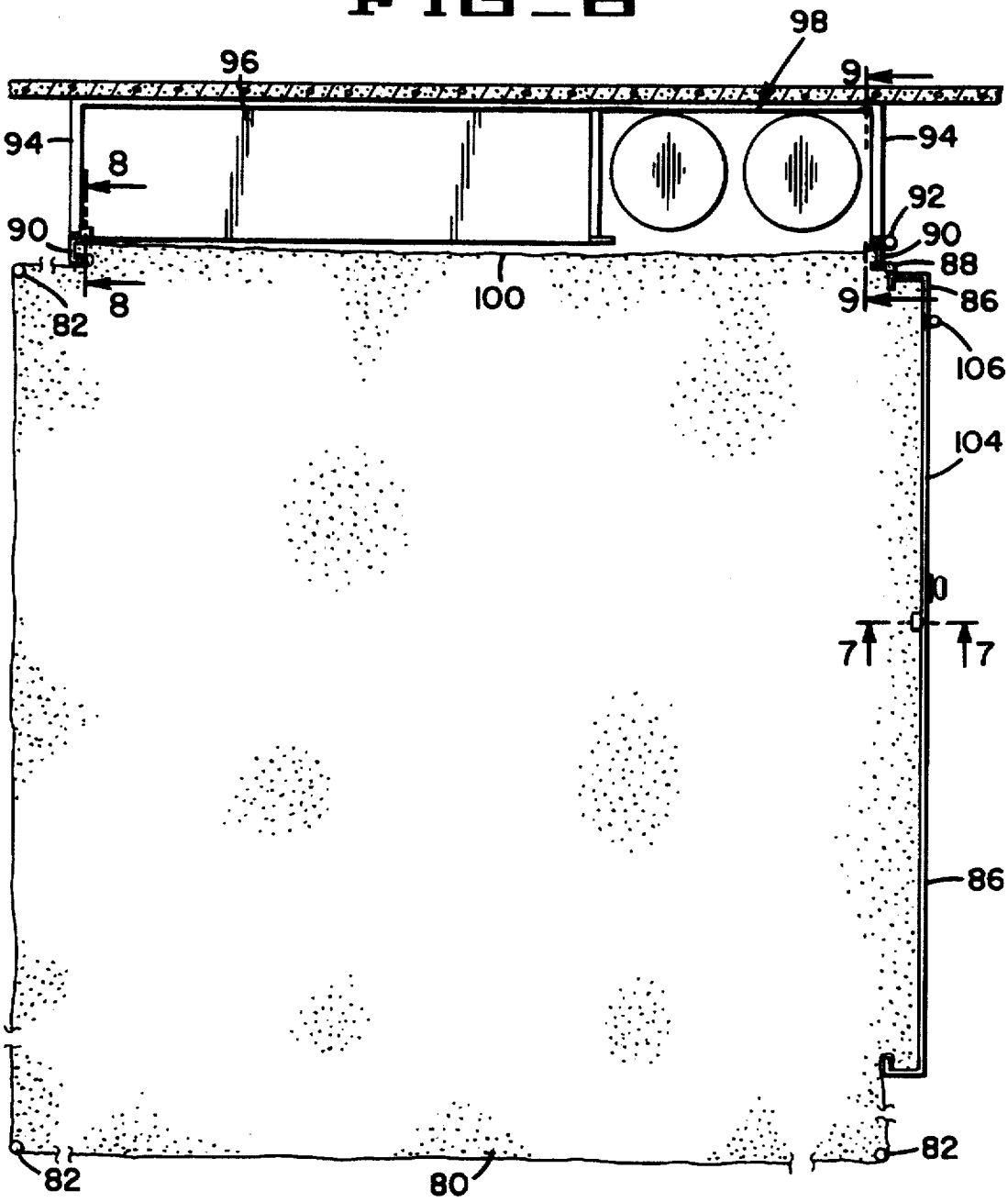
FIG. 6 is a horizontal section through the building protection system shown in FIG. 4.

The plan view of FIG. 3 represents the arrangement of a typical CPS. Entry to the building 10 is through doors 14 and 54 which lead into respective air locks 44 or 58 formed by interior doors 46 and 56 and their respective interconnecting walls. A decontamination area 48 is incorporated into the air lock to permit those who may have been exposed to the toxic agents to remove their clothing, place contaminated materials in a sealable container 50, which minimizes the contamination inside of the airlock 44, and shower or take other decontamination action to neutralize or remove the toxic agent. Airlock 58 could also be provided with a decon area, similar to 48, and a sealable container, similar to 50, if needed by the specific application. The resulting shower waste water is preferably collected and stored in a waste water storage tank 52 to preclude distribution of the toxic agents beyond the threatened area through the community sewage system. After the threat has passed, disposal of the container 50, the tank 52 and their contents can be effected in accordance with applicable environmental and safety regulations. Once decontaminated, the individual can dress in spare clothing before passing through the interior door 46. Commercially available toxic agent detection monitors may be installed at entry points to and within the decon area of the CPS to enhance the safety of the CPS' internal environment by alerting the CPS site manager and persons entering the shelter of the presence of agent. Such commercial monitors may be installed both on the interior, as previously described, and on the exterior, and such monitors can be integrated into a comprehensive monitoring system tied into the PAS communication and command and control center. Both air locks 44 and 58, which can be achieved by partitions or curtains and a series of baffles in lieu of interconnecting walls and swinging doors, minimize the ingress of toxic agents into the interior as a result of the entry of potentially contaminated community members. When the decontamination area 48 has not actually been used for decontamination, the showers provided therein may be used for general hygiene purposes by the occupants in the event of extended periods of confinement within the building. While the interior of the building 10 can be designed to meet the specific needs of the intended occupants, the building 10 must include the features to ensure protection of its inhabitants from toxic threat agents, such as the air management system, the decon area, auxiliary power and etc., as described herein. The interior of the building 10 includes an open sleeping area 60 which is provided with a bunk bed system, preferably two or three high, and with reading and safety lighting. A rest room 62 with conventional toilet facilities, modified to minimize agent ingress into the CPS from municipal sewer system, is provided at one end of the building and a kitchen 66 with conventional means for preparation and storage of food is provided at the other end thereof. Adjacent to the kitchen 66 is a securable storage room 68 and securable cabinets in which food and drinks, as well as medicine, clothing, decon kits, and hygiene and other supplies, are stored. Between the storage room 68 and the air lock 44 is a securable control room 70 which contains the facilities for communication with the master control station and functions as the control center for the building 10. An air management subsystem 72 is provided to remove the toxic agents from air drawn from the exterior environment and discharged into the interior of the building 10. The details of the air management subsystem 72 will be explained hereinafter, but it is important to note that the system is comprised of a plurality of individual modules 74. This use of a plurality of modules 74 operating in parallel is extremely advantageous because it allows a modular design that can be readily adapted to buildings of different sizes, and permits the use of a single filter module design in not only the community protection systems but also in the building protection system and decontamination system (each to be described) thereby reducing the cost of manufacture, installation, maintenance and training, while enabling a faster repair cycle by simply replacing a malfunctioning module with another and permitting a universal communication and control linkage between each module and a master control station permitting automatic actuation when a threat is detected, monitoring the status during operation and routine testing of the modules, all from a remotely located master control station. However, the most important attribute of the modular design is that it eliminates the possibility of a single point failure, i.e. the air management system 72 is capable of effective operation in a degraded mode. Even if one of the modules 74 should fail to operate, the other modules in the system 72 will supply properly filtered air without degrading the level of protection required, i.e. all toxic agents will be removed from the air introduced to the building and the volume of air supplied will be sufficient to create an air pressure inside the building which is slightly higher than outside the building. Over-pressurization of the building is essential to preclude infiltration of contaminants, i.e. the over-pressurization assures that the flow of air through all leaks will be from the inside to the outside of the building. The air flow requirements for over-pressurization of the building can be managed to some extent by reducing the possibility for air leaks, such as by reducing the number of movable windows and door openings employed, by application of sealants to those areas of known or suspected leaks, through utilization of efficient entry/exit designs, for example, use of double doors and/or baffles, etc., and through the utilization of procedures for use that reduce air loss as people enter and exit.

Figure 7:
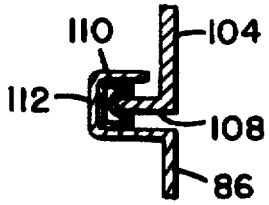
FIG. 7 is a detail sectional view taken on line 7—7 of FIG. 4 and rotated 90 degrees, and showing a type of door perimeter seal which may be applied.
Figure 8:
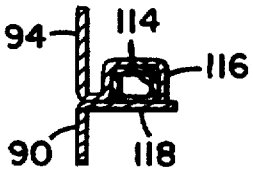
FIG. 8 is a detail sectional view similar to FIG. 7 taken on line 8—8 of FIG. 4, and showing a type of housing joint seal which may be applied.
Figure 9:
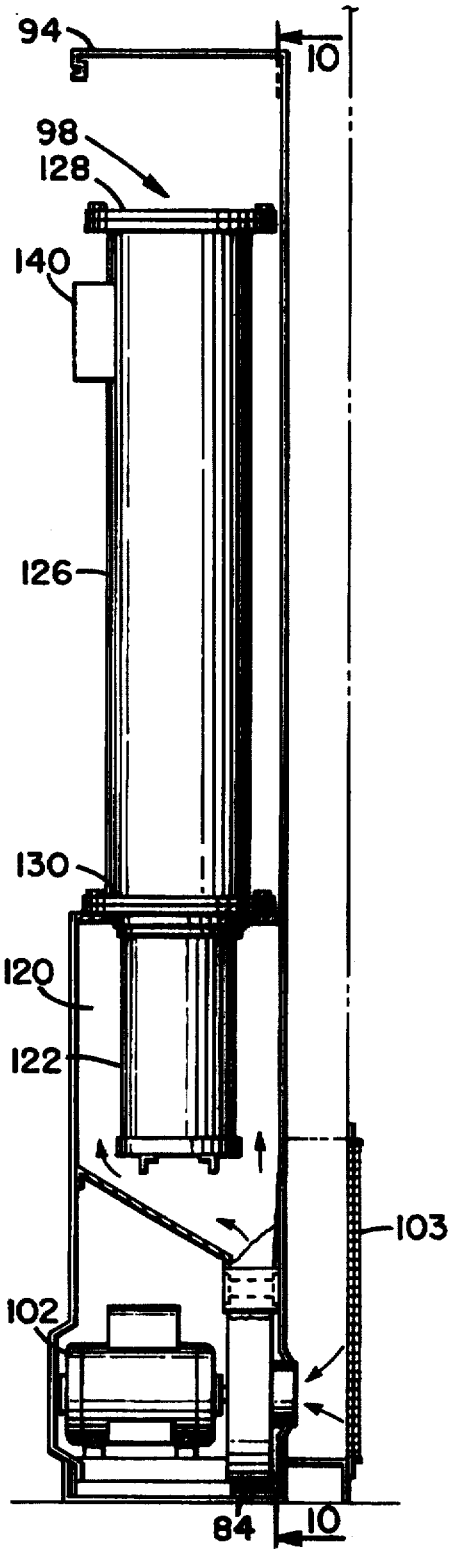
FIG. 9 is a side elevation view of an integrated protective action system filtration module.
Figure 10:
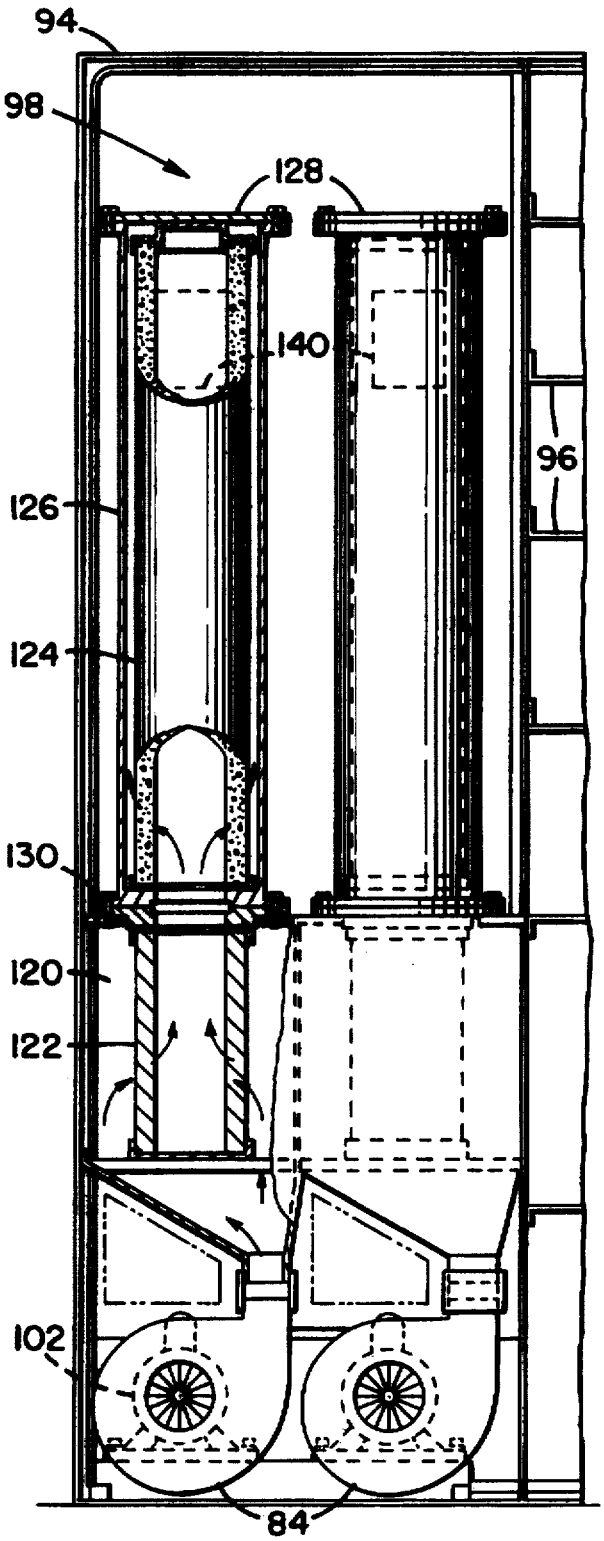
FIG. 10 is a sectional view taken on line 10—10 of FIG. 9.

A building protection system (BPS) is shown in FIGS. 4–10, and is distinguished from a community protection system (CPS) by the fact that it is installed in and deployable within a room of an existing building, such as a school, daycare, business, factory, hospital or home, for example. It is intended to provide protection for a select group of individuals who cannot be readily relocated to a CPS or evacuated within the time reasonably expected to be available between detection of and exposure to a toxic threat. The BPS is shown in its fully deployed configuration in FIG. 4, in which a floored tent 80 is held erect by supports 82 and inflated and over-pressurized by flow of air from the blowers 84, as best seen in FIGS. 9 and 10. The tent 80 can be made of lightweight rip-stop material which is relatively impervious to air penetration and is flexible to permit it to be compactly folded within a panel 86. The panel 86 is hinged at 88 to an open frame 90, which frame is in turn hinged at 92 to a cabinet 94 secured adjacent to a wall of the room. Opposite the hinges, the panel can be releaseably latched to the frame 90 and the frame releaseably latched to the cabinet 94. When the panel 86 remains latched to the frame 90, and the frame unlatched from the cabinet, the panel and frame can be swung, i.e. opened or closed, as a unit on the hinge 92 as shown in FIG. 5. In this configuration, there is free access to a plurality of shelves 96 to replenish or replace supplies required by the occupants of the BPS when deployed. The supplies would be similar to those described in connection with the CPS. Access to the air filter modules 98 is also then possible for maintenance, service and repair or replacement thereof. A coarse mesh net 100 is secured around and spans the opening of the frame 90 and holds the tent 80 folded against the panel 86. When the frame 90 remains latched to the cabinet 94 and the panel 86 is unlatched from the frame 90, the panel will swing on hinge 88. Since the tent 80 is sealingly secured around the periphery of the frame 90 and to the periphery of the panel 86, the tent 80 will begin to unfold. Movement of the panel 86 relative to the frame 90 will activate the system. Air from the blowers will be forced into the tent 80 further causing the tent to unfold. When the panel 86 has rotated to be substantially transverse to the wall to which the cabinet 94 is secured, the individual deploying the BPS can open an entry door 104 mounted on hinges 106 in a complementary opening in the panel 86 and enter the then partially erect tent to further unfold the tent and to position and secure the supports 82 that were stored on the inside of the panel 86. Security locks are provided on the latches that secure the panel 86 to the frame 90 and the frame to the cabinet 94 to insure that only authorized personnel can activate the BPS and access the supplies on the shelves 96 and the filter modules 98. The BPS may have a need for an integrated air lock at 104 to provide a two-door entry way and minimize ingress of toxic agent into the BPS tent. The primary function of the BPS is to provide shelter to its occupants prior to the presence of the toxic threat agents near the BPS site. An airlock at 104 would provide an added capability to the BPS to enable contaminated persons to enter the BPS without posing a threat to the interior and the occupants. As shown in FIG. 7, the entry door 104 is sealed when closed to eliminate unwanted air leakage by a lip 108 formed on the edge of the door 104 engaging a compression seal 110 mounted in a channel 112 formed around the complementary opening in the panel 86. Similarly, as shown in FIG. 8, a compression seal 114 seated in, and normally protruding from, a channel 116 formed around the periphery of the cabinet 94 is engaged by a flange 118 formed around the periphery of the frame 90 and on the side adjacent the cabinet 94 to eliminate unwanted air leakage between the cabinet 94 and the frame 90.

The air management system for the BPS shown includes two identical modules 98, so an explanation of one will be sufficient for an understanding of both. Since it is intended that the air management systems for the PAS be modular and redundant, it is to be understood that the modules 98 could, and preferably are, also used in the community protection systems and in the decontamination system. The modular filter design reduces both maintenance and training requirements, as well as providing redundancy for effective system operation. The impeller of the centrifugal blower 84 is driven by an electric motor 102. Air is drawn through a grill 103, covering an opening in the wall to which the cabinet 94 is secured, into the housing of the blower and discharged into a sealed chamber 120. The aforementioned wall can be an exterior wall, but preferably is an interior wall so that air drawn by the blower 84 has already been conditioned, i.e. heated or cooled, in the event the heating, ventilating and air conditioning system for the building in which the BPS is deployed remains functional. A particulate filter 122, which preferably is a high efficiency particulate air filter (HEPA filter), is supported in the chamber 120 and removes any particulate larger than 0.1 microns in size, which would include aerosols, bacteria and viruses; virtually everything except for gases. The particulate-carrying capacity of the filter 122 does not have to be great since the air is drawn from the interior of the building. The particulate-filtered air is then discharged into the interior of another filter 124 which is axially aligned with the filter 122 so that the interior of the two filters are in direct communication. The filter 124 is formed of a material, such as activated charcoal, which is capable of removing toxic gases, such as nerve gas and mustard gas. A rigid sleeve 126 encompasses the filter 124 and is sealed by top and bottom plates 128 and 130. Air flows from the interior of the filter 124 into the space between the sleeve 126 and the filter 124; toxic agents, particulates and gases, being removed in the process. A discharge duct 140 is secured near the top, and communicates with the interior of the sleeve 126 to direct non-contaminated air into the tent 80. The filters 122 and 124 can be removed, properly destroyed and new filters installed, if the life of the filter media selected requires, following operation in a toxic threat environment.

Figure 11:
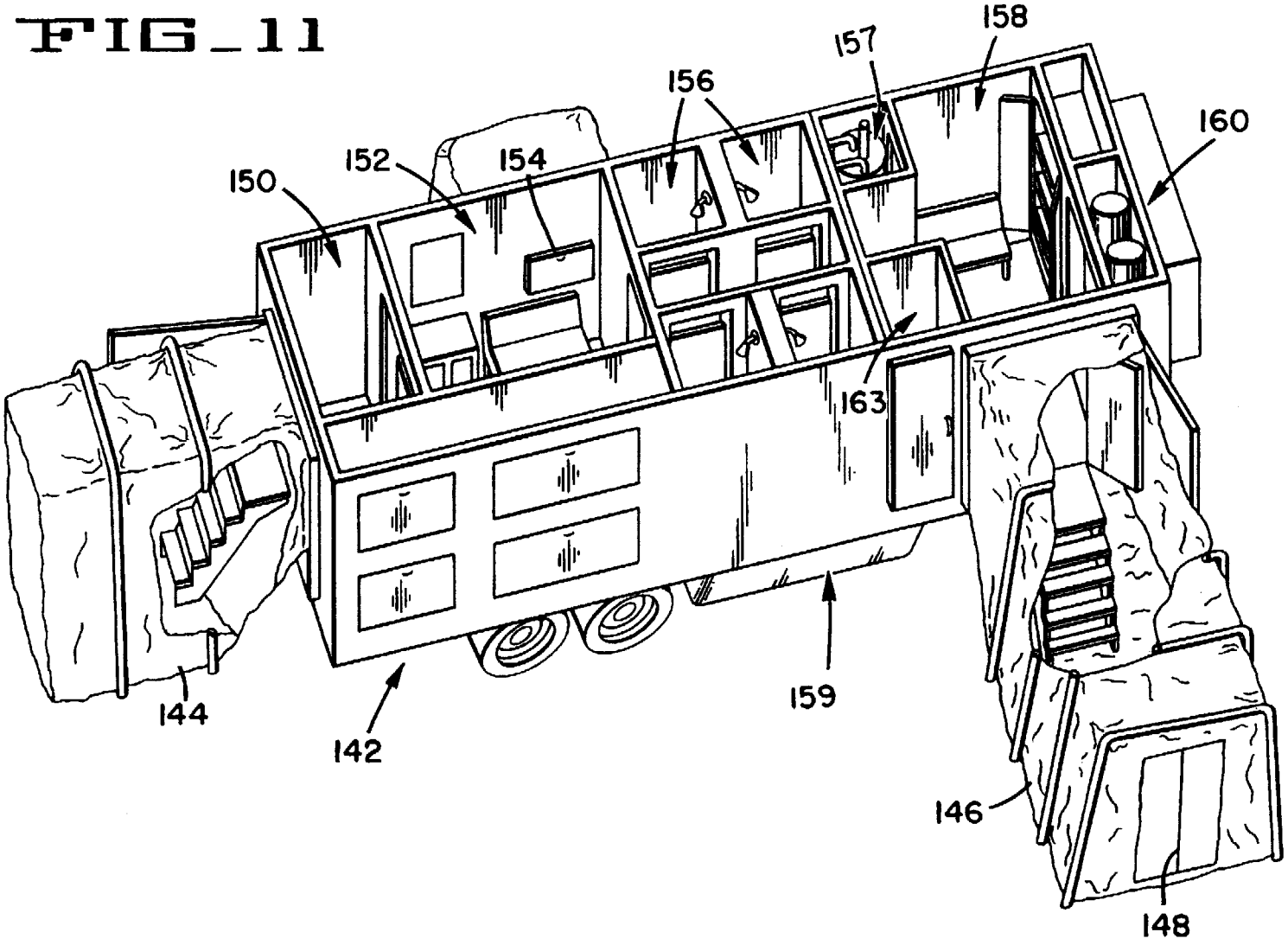
FIG. 11 is a pictorial view of a decontamination/rest and relief station incorporating a protection system according to the present invention.

A decontamination system (DCS), shown in FIG. 11, is preferably mounted in a towable trailer 142 so that it may be quickly and effectively positioned in response to a toxic threat, or to permit temporary use as a mobile emergency medical treatment center or simply as a rest and relief station at public events and during states of emergency. Accordion extendible and inflatable tents 144 and 146 are sealingly secured respectively to the entrance, at the left as viewed in FIG. 11, and the exit of the trailer 142. The free end of each tent is closed but provided with a slit opening and/or flexible door opening, as shown at 148, to allow passage of a person while minimizing air leakage and the ingress of contamination from the external environment. The extendible tents 144 and 146 are supported by framework consisting of spaced inverted U-shaped members to provide stability to the tents when they are inflated and to facilitate rapid extension for operational use and collapse to a stowed configuration for transport. The use of the extendible tents 144 and 146 enables the decontamination process to proceed at a higher rate, because persons to be processed can remove some of their contaminated garments while in the entrance tent 144, so the time required to complete that task inside the trailer 142 is shortened. Bagging and discarding contaminated articles, including clothing resulting from the process of disrobing, at least partially, within the tent 144 also minimizes the transport of contaminated items into the DCS, thereby helping to minimize the transfer of contamination into the system. In addition, the people processed in the trailer can assemble in the exit tent 146 awaiting evacuation so congestion within the trailer is reduced. The air management system within the trailer will provide non-contaminated air to, and over-pressurize the tents 146 and 148, as well as providing non-contaminated air and over-pressurization to the decontamination trailer itself. The tents also serve to shield individuals from the elements before and after the decontamination process. Additionally, the exit tent 146 can provide a protected area where emergency response crews may, after having been decontaminated, rest and recover before returning to work. The tents also provide psychological benefit to persons in a threat environment by providing a physical barrier between them and the threat, instilling a sense of security. An airlock room 150 where a person receives an air wash from clean air provided by the air management system to remove vapor contamination is provided immediately upon entry to the trailer 142. All remaining garments are removed in the pre-decontamination room 152, and are bagged and disposed of by passing them through the dump door 154. Storage for decontaminate kits, shower articles and the like is provided in this room 152. A plurality of individual shower rooms 156, each supplied with non-contaminated water held in heater tank 156 and having a floor drain connected to collection tank 159, are provided for washing any contaminants remaining, after use of the decontamination kits, from the body and hair. Masks are the only item permitted to accompany a person into the shower room. Masks are decontaminated in the airlock room 150, placed in a sealed, waterproof bag and taken through the various rooms of the DCS and into the dressing area 158. A mask is therefore available for use by each person, if needed, following decontamination. Decontaminated persons can then dress in the dressing room 158 in which clean, non-contaminated clothing, as well as other appropriate supplies such as food, water and emergency first aid kits, have been stored.

The decontamination trailer 142 is provided with an air filtration system 160 similar to that shown in FIGS. 9 and 10 with electrical power supplied by an external generator or other power source. The air filtration system 160, which draws outside air, can provide over-pressurization to the trailer 142 and the tents 144 and 146 by sizing the power, air filtration and environmental systems to also accommodate the volume of the tents and the relatively high leakage rates they inherently present. The air conditioning system installed in room 162 includes a conventional air conditioning system to provide conditioned air to the inlet of the filters, which air conditioning system is arranged to recirculate and cool the interior air in order to reduce the capacity requirements therefor. Access doors are provided on the decontamination trailer 142 immediately adjacent the air management system 160 to permit direct access thereto from the exterior of the trailer and allow filter changeout without exposing the interior of the decontamination trailer to possible contamination. A small control room 163 in the trailer 142 is provided with means to communicate with, and link to a master control station through radio frequency to communicate status and emergency conditions. A radio link between the control room 163 and the tractor which tows the DCS is also furnished. Communication between the rooms of the DCS is achieved through a conventional intercom system.

Figure 12:
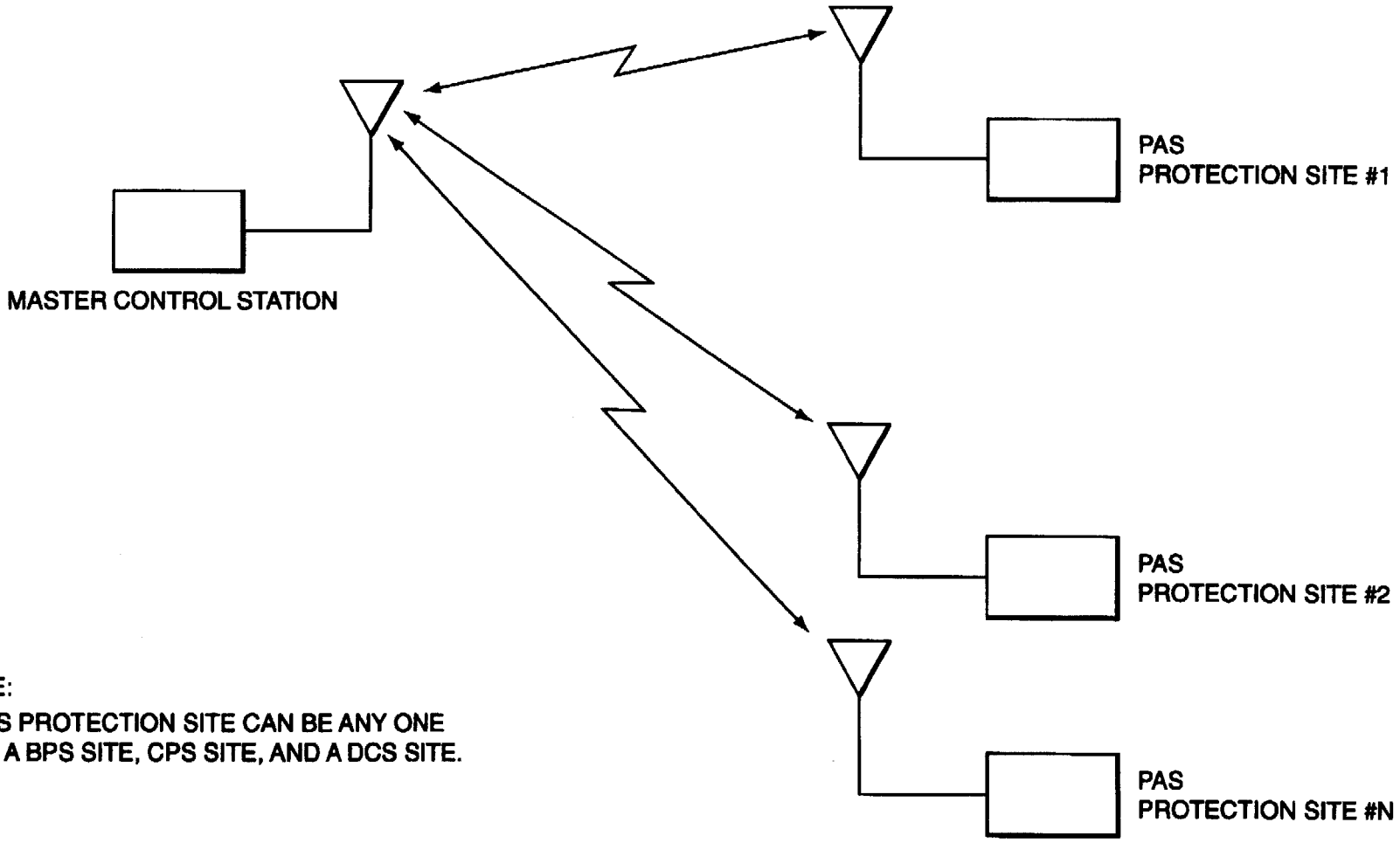
FIG. 12 is a schematic representation of the communication and command control system between the master and the integrated protective action systems (PAS), which may be either community or building protection systems (CPS or BPS), or the decontamination system (DCS)

The communication and control for PAS, shown schematically in FIG. 12, utilizes two way digital and voice communications between a master control station (MCS) and each of the PAS, which is capable of broadcasting warning and activation signals. Two way communication between the MCS and each PAS is essential to reduce fear and anxiety, not only of the occupants of the PAS but also of their absent relatives and loved ones, and the detrimental psychological effects resulting from being sequestered in confined quarters, especially if there is no information from the outside world. The communication and control system shown in FIG. 12 comprises a two way radio frequency (RF) link, which could be one channel of an 800 Mhz trunked radio system. The RF downlink can broadcast emergency information, both in voice or analog and data or digital form, including command codes, to the PAS. To allow the MCS to control specific PAS units, each PAS is assigned a unique computer code identity so that only the targeted PAS will recognize and respond to broadcast commands intended for that PAS. It is, therefore, possible for only selected BPS and CPS shelters and DCS trailers to be activated by the MCS by broadcasting signals incorporating appropriate identity codes over the RF link. The same signals can alert individuals to seek protective shelter. The automatic activation of the PAS is an important attribute of this invention because it reduces the possibility of human error under circumstances when such errors are more likely. It also ensures that the CPS shelters, and/or other appropriately identified PAS, are functioning and fully operational before the prospective occupants arrive, facilitating their orderly entrance and with the building over-pressurized before their arrival, minimizing the infiltration of contaminants. The RF downlink also can periodically poll each PAS when there is no emergency to carry out test and diagnostic procedures to insure proper system status and operation, and to identify faults or deficiencies for correction. For example, the motors driving the blowers in a specific PAS can be energized by the MCS and the proper operation of each blower confirmed, for example, by sensing the pressure difference between the inlet and outlet sides of that blower.

Figure 13:
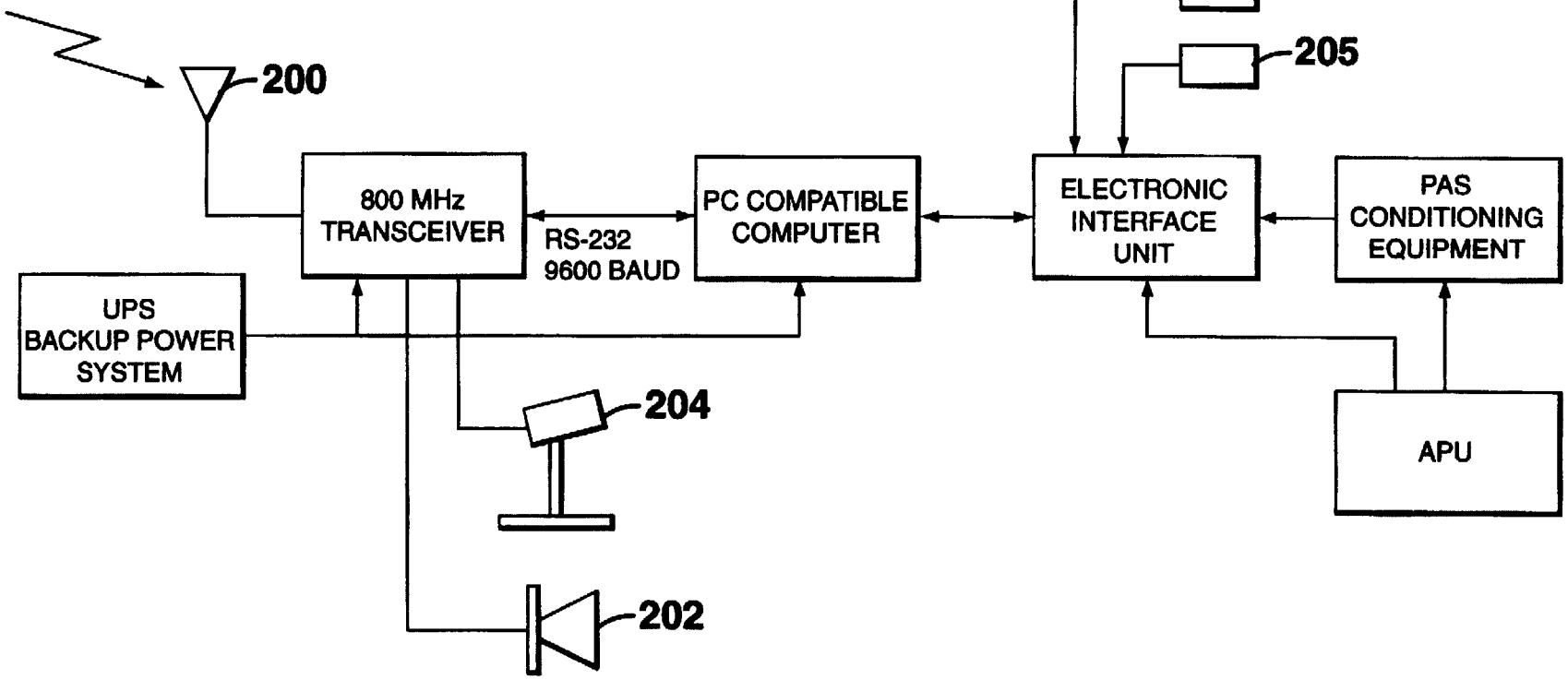
FIG. 13 is a schematic representation of the communication systems which are common to all PAS's.

FIG. 13 schematically represents that portion of the control station which is common to all BPS, CPS and DCS. The antenna 200 receives from and transmits to the MCS signals at an appropriate frequency, such as 800 Mhz. An 800 Mhz transceiver is connected to the antenna 200 and converts voice signals received by the antenna so they can be heard from the speaker 202. Words spoken into the speaker 204 are converted by the transceiver and transmitted by the antenna 200, which transmitted signals are received by the MCS antenna and converted by a similar transceiver and speaker in the MCS. The PAS transceiver is also connected to a computer through a conventional cable, such as an RS-232 cable communicating at a specific baud rate. Digital data received by the transceiver is thus transmitted to the computer for decoding and processing by software installed on the computer. An electronic interface unit connects the computer to the auxiliary power unit (APU) for that PAS and to the PAS air management system (PAS conditioning equipment) so that commands sent from the MCS can be implemented by the equipment incorporated therein permitting the MCS to control the operation of the systems in the PAS. Similarly, the output from sensors monitoring the status of various portions of such equipment can be sent to the MCS, when polled by the MCS for such information. A chemical detector 205, which may be an ACADA detector from the U.S. Army or a NATO detector capable of detecting toxic chemical agents at low concentrations, is mounted to monitor the air inside and/or outside of the PAS. Depending on the type and variety of chemical, biological and/or particulates that may be expected to threaten the community, more than one type of detector 205 may be employed. The output from the detector(s) 205 is fed to the computer through the interface unit and will provide the PAS with which the detector is associated with an indication of whether toxic agents are present in the ambient atmosphere, and/or the interior environment of the PAS. Another group of sensors 207 is also provided at each PAS to provide indications of the local weather conditions, e.g. outside air temperature, humidity, and wind speed and direction in the immediate vicinity of the PAS. When polled by the MCS the output from the detector(s) 205 and the weather conditions from the sensors 207 can be transmitted to the MCS, where the scope of the threat can be assessed and a determination made regarding the appropriate responsive action. The output from the detector(s) 205 and sensor(s) 207 can also be fed to the PC compatible computer at each BPS, CPS and DCS site to provide associated on-site data.

Figure 14:
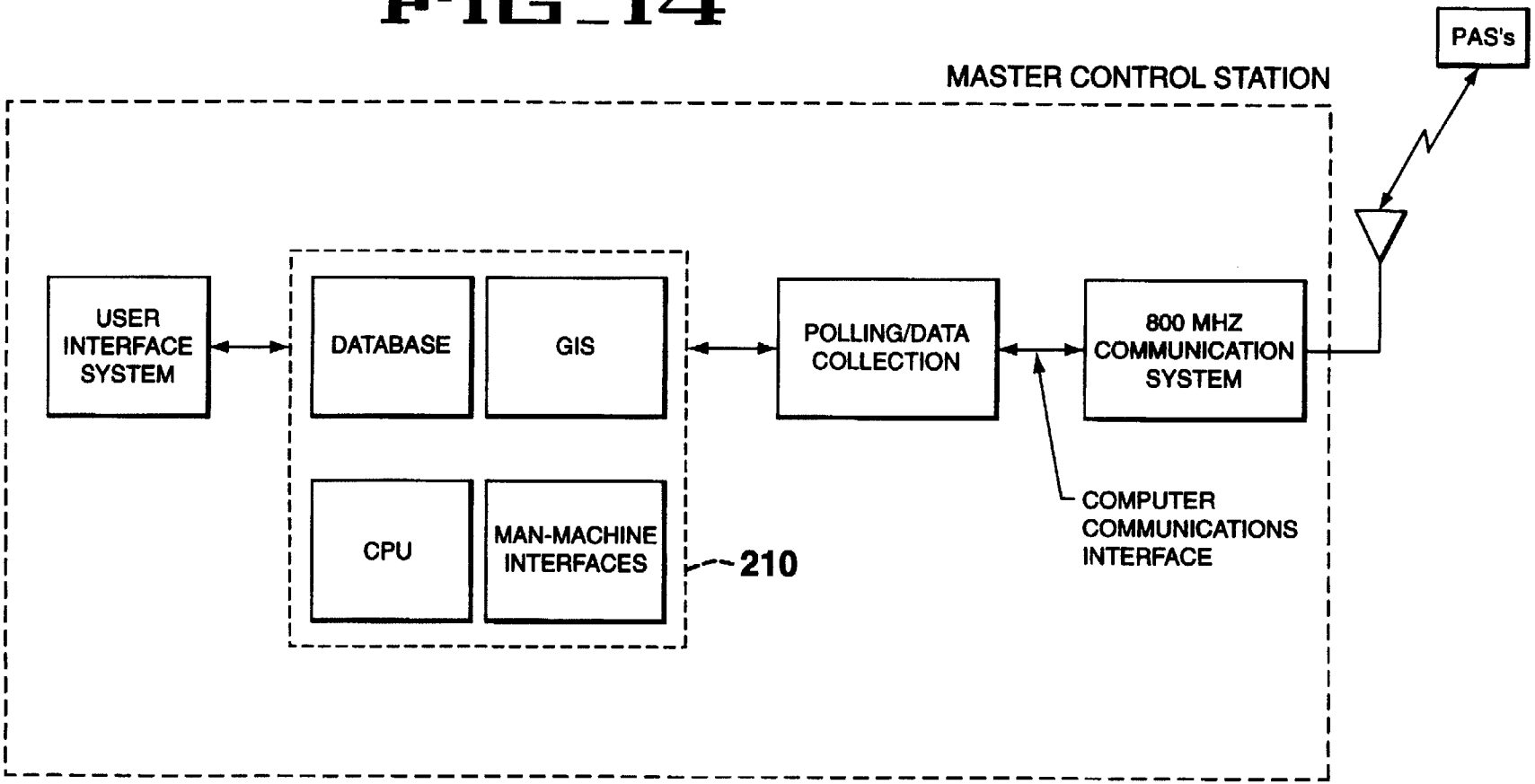
FIG. 14 is a schematic representation of the data collection and display functions of the master control station.

The master control station (MCS), which is the central server of a distributed network with each CPS, BPS and DCS being a node on that network, is illustrated schematically in FIG. 14, and includes a transceiver or communication system operating at a particular frequency, such as 800 Mhz, for example, connected to an antenna for RF communication with the PAS's. The transceiver is connected through proper cable, such as an RS-232 cable to a computer 210 which includes a central processing unit (CPU) and software and memory for maintaining databases, a geographic information system (GIS) and man-machine interfaces. The databases contain information relating to the community, such as community demographics, PAS locations, the names of and personal data concerning the individuals assigned to each PAS, and data regarding maintenance records, requirements and schedules, and status of supplies at each PAS, for example. The MCS communicates with each PAS on a predetermined schedule to keep the information in the databases current. The MCS also has the capability to poll each PAS as needed to acquire data regarding its present status and operability. The GIS provides a graphic display, in the form of a computer generated map, on a monitor showing the location and status of each PAS, based upon and derived from the information in the databases. Such an arrangement provides a visual display of the data for personnel operating the MCS which permits timely activation of the appropriate CPS and BPS, rapid and optimum deployment of DCS and emergency workers and which reduces the possibility of error. Since the data so acquired can also include the output from the detector 205, the GIS can display a geographic map of the community with an overlay of the toxic plume. Using a computer model for distribution of a particular toxic agent, and the data provided by the sensors 207, the computer can calculate, and the GIS display, predicted changes in the plume over time. Personnel in the MCS are, thus, able to reach decisions more quickly and with real-time accuracy, such as which PAS, if any, require activation and for how long, and providing the instructions for the shortest, yet safest, route to take during evacuation of a particular PAS, for example.

FIG. 15 is a schematic representation of the control portion of a BPS located in a building having a plurality of BPS's installed therein, and the link between the BPS command center and the MCS. The BPS command center, which may itself be a BPS, contains the control station electronics shown in FIG. 13 and is capable of two-way communication with the MCS. The BPS command center communicates with each of the other BPS shelters within the same building relaying commands the command center receives from the MCS to the systems of each BPS and receiving information regarding status from each, which information can then be sent by the, command center to the MCS when polled to do so. A convenient way to relay the MCS command signals to the systems of, and receive digital data concerning status from, each BPS is through the wires already provided in existing buildings to normally carry standard 110 volt electrical power.

FIG. 16 illustrates another mode of communicating with the MCS. In this embodiment, the PAS communication, warning and control system receives incoming messages from the MCS via RF signals, such as an 800 Mhz radio receiver, for example, and sends messages and data to the MCS over telephone lines. A modem connects a local controller with the MCS through the phone lines of the local phone company. While this arrangement has the attribute of somewhat lower cost, the reliability can be no greater than that of the local phone system itself. It is during times of emergency, when communication with the MCS is absolutely essential, that phone companies are deluged with phone calls causing the phone system to become overloaded and, therefore, only sporadically operable. In order for this arrangement to function reliably, acquisition of dedicated, uninterruptable phone lines must be installed and used only for communication between the MCS and each of the PAS.

While a particular embodiment of the invention has been shown and described, it will be obvious to those skilled in the art that changes and modifications may be made without departing from the invention in its broader aspects, and, therefore, the aim in the appended claims is to cover all such changes and modifications as fall within the spirit and scope of the invention.

What is claimed is:

1. A deployable shelter for use in an existing building comprising:

a cabinet secured inside said building;

an open frame hinged to said cabinet and releaseably secured thereto;

a panel having a door opening hinged to said frame and releaseably secured thereto;

a door hinged to said panel to cover said opening and releaseably secured thereto;

a enclosed tent sealingly attached to said frame and said panel and foldable within said frame when said panel is secured thereto;

an air management system positioned in said cabinet for supplying air to said tent under pressure and free from toxic agents;

whereby said frame and said panel when secured together may be pivoted about the hinged connection of said frame to said cabinet to permit servicing of said air system and when said panel is released from said frame, while said frame remains secured to said cabinet, pivoting of said panel about its hinged connection to said frame will cause said tent to be unfolded from said frame.

2. The invention according to claim 1 further comprising:

supply storage shelves secured inside of said cabinet; and a large mesh net secured to said cabinet side of said frame to retain said tent within said frame when said frame is pivoted away from said cabinet and which will allow access to said shelves for retrieval of supplies stored thereon when said shelter is deployed.

3. The invention according to claim 2 further comprising:

means for receiving a command signal calling for deployment of said shelter;

means for simultaneously releasing said panel from said frame and activating said air system in response to said signal, whereby the air pressure from said air system will cause said panel to pivot away from said frame, pulling said tent from said frame, and will cause said tent to unfold and move toward its deployed position.

* * * * *